United States Patent [19]

Caldwell et al.

[11] 4,283,717

[45] Aug. 11, 1981

[54] MONITORING SYSTEM FOR A DIRECT-WIRE ALARM SYSTEM

[75] Inventors: Carl W. Caldwell, Columbia; Rick A. Britton, Springfield, both of Mo.

[73] Assignee: Digital Monitoring Products, Springfield, Mo.

[21] Appl. No.: 80,291

[22] Filed: Oct. 1, 1979

[51] Int. Cl.[3] ..... G08B 29/00; G08C 9/00

[52] U.S. Cl. ..... 340/506; 340/508; 340/511; 340/518; 340/661

[58] Field of Search ..... 340/506, 502, 503, 505, 340/500, 508, 511, 512, 657, 517, 660-664, 518, 522, 525, 526; 179/5 R, 5 P

[56] References Cited

U.S. PATENT DOCUMENTS

| | | | |
|---|---|---|---|
| 3,219,991 | 11/1965 | Freitas | 340/661 |
| 3,431,557 | 3/1969 | Thomas et al. | 340/661 |
| 3,534,353 | 10/1970 | Calkin et al. | 340/661 |
| 3,786,501 | 1/1974 | Marnerakis | 340/511 |
| 4,103,337 | 7/1978 | Whiteside | 340/505 |

*Primary Examiner*—John W. Caldwell, Sr.
*Assistant Examiner*—Donnie L. Crosland
*Attorney, Agent, or Firm*—James H. Chafin

[57] ABSTRACT

A direct-wire alarm system for scanning and monitoring a plurality of security alarm systems located in various user's facilities. The device monitors each line sequentially and converts current levels present on each line to a digital value. A digital filter is utilized to eliminate periodic line noise while a second digital filter is utilized to eliminate pulse noise. The system further comprises a line ringing system for notifying the user of a line condition and an adjustable comparator for obtaining high resolution of line current values.

14 Claims, 7 Drawing Figures

MONITORING SYSTEM FOR A DIRECT-WIRE ALARM SYSTEM

BACKGROUND OF THE INVENTION

1. Field of the Invention

The present invention relates to a digital monitoring system and more particularly, but not by way of limitation, to a digital device for rapid sequential monitoring of a plurality of direct current loops used primarily in security alarm systems.

2. History of the Prior Art

Typically, silent security alarm systems are utilized by businesses and residential homes to monitor the status of various security devices such as door and window switches, electric eyes, thermostat, heat or smoke detectors and the like.

The various security devices are normally connected in series with a direct wire loop which, in turn, is connected to a central monitoring facility. An electrical current is passed through each of these loops and the current level is monitored and compared to a pre-determined current level representing the normal status.

Typically, the current level of each such loop being monitored is by the use of relays, meters, switches, lights and the like provided on each loop. If a security device is tripped, the current level deviation is either manually noted or a relay is tripped thereby lighting a light or sounding an audible alarm to notify the monitoring facility.

Since most direct line security systems utilize leased telephone lines, such lines are constantly in the proximity of electrical transmission lines and electrical appliances. Such direct-wire systems are therefore constantly plagued with 60 Hz line noise which causes false alarms, and generally hampers monitoring operations.

Further, such systems are always susceptible to noise of a random pulse nature such as that caused by lightning or other random static discharges.

The technological advances in digital electronics provides an efficient means of monitoring security alarm systems but past efforts at utilizing high speed digital monitoring systems have been plagued with noise problems of a pulse nature and of the 60 Hz variety requiring that the noise be filtered in the analog form prior to converting to digital form.

Further it was found to be extremely difficult to obtain the resolution necessary since the security equipment varies considerably from one user to another.

Another problem arose in communicating with the user to notify the user that its system was in normal operation when it is turned on.

Typically when the user closes his office for the day, the security equipment is turned on and connected on line. The monitoring facility then manually switches the line to an AC source for a period of time to inform the user that its security system is on line and operating normally. This process is both time consuming and expensive from a man power standpoint.

SUMMARY OF THE INVENTION

The present invention provides an automatic direct-wire alarm monitoring system for digitally monitoring an analog signal in the form of a closed loop electrical current wherein each user's security equipment is series connected so that when an alarm is tripped, the current either increases or decreases outside a pre-determined band.

The present invention includes a ring driver which is operably connectable to one of two different current interrupter circuits to provide AC or DC power along the direct-wire loop to operate the user's signaling bell or buzzer. Therefore, the user's bell or buzzer does not have to be connected to a local power source and the ring driver current is automatically applied to the proper line when the alarm circuit is turned on.

In the present invention, the current level present in each user's loop is first converted to a corresponding voltage level, which, in turn, is converted to a digital value before any filtering takes place.

This is accomplished by a voltage comparator which compares the incoming voltage level to a staircase voltage signal generated within the monitoring unit. The voltage level of the staircase may be slightly adjusted up or down to provide finer resolution of the line current.

Once the line current for each user's line has been converted into a digital value, each of the user's lines is sequentially monitored by a status monitoring unit. The digital value is first processed through a high-speed notch filter whereby 60 Hz noise is eliminated. This is accomplished by sampling the line current a pre-determined number of times during each cycle of a 60 Hz signal and then integrating those samples over each cycle.

Hence, any 60 Hz noise will cancel in the integration process. However, in practice, due to truncation and rounding effects of the low resolution signals used by the system, it was found to be desirable to weight the new filtered result toward the previous filtered result. Satisfactory results were obtained by digitally adding three-fourths of one-fourth of the sum of the last four samples to one-fourth of the previous filter result and then by adding an appropriate rounding constant to obtain a current filter result.

This 60 Hz filter result is then digitally compared to the last stable state value for that particular line to determine whether there has been a possible change in value indicating an alarm condition.

If no alarm condition appears, the status monitoring system continues to scan the user's lines. On the other hand, if a variance appears between the notch filter result and the last stable state value, the value is passed through a digital pulse filter which is designed to eliminate noise pulses caused by lightning and other line noise of a pulse nature. This pulse filter will also eliminate an apparent pulse created by the digital notch filter when an exceptionally large 60 Hz noise signal is present. The maximum length of noise pulse to be filtered is strapped selectable by a counter apparatus in the pulse filter.

The input to the pulse filter is not gated to the output until it has remained stable at one value for a given number of samples in order to eliminate noises caused by pulses in the line. This is accomplished by holding the previous filter result in a register for comparison with the current value. If previous and current values are equal, it is reset. On the other hand, if the storage counter reaches the strapped count, a new state value is gated out of the pulse filter to a stabilized state register and to the central processing unit thereby indicating an alarm condition.

Once a change is detected in the pulse filter input, it must restabilize at some value before another fault time-out counter reaches the maximum count. If it does not stable in time, a fault condition results to alert the central processor unit to a pulse noise problem.

Unlike an analog filter, this pulse filter is unaffected by pulse amplitude, and is therefore able to eliminate most line noises while retaining a fast response time.

Hence, the present invention provides a single status monitoring unit which is capable of digitally monitoring each of the user's lines sequentially. The capacity of each status monitoring unit is naturally dependent upon the time increments into which the samples are taken. In the present embodiment, samples are taken 4.096 ms. apart thereby allowing the monitoring unit to scan up to 4,096 current loops.

DESCRIPTION OF THE DRAWINGS

Other and further advantageous features of the present invention will hereinafter appear in connection with a detailed description of the drawings in which.

DESCRIPTION OF THE PREFERRED EMBODIMENT

Figure 1:
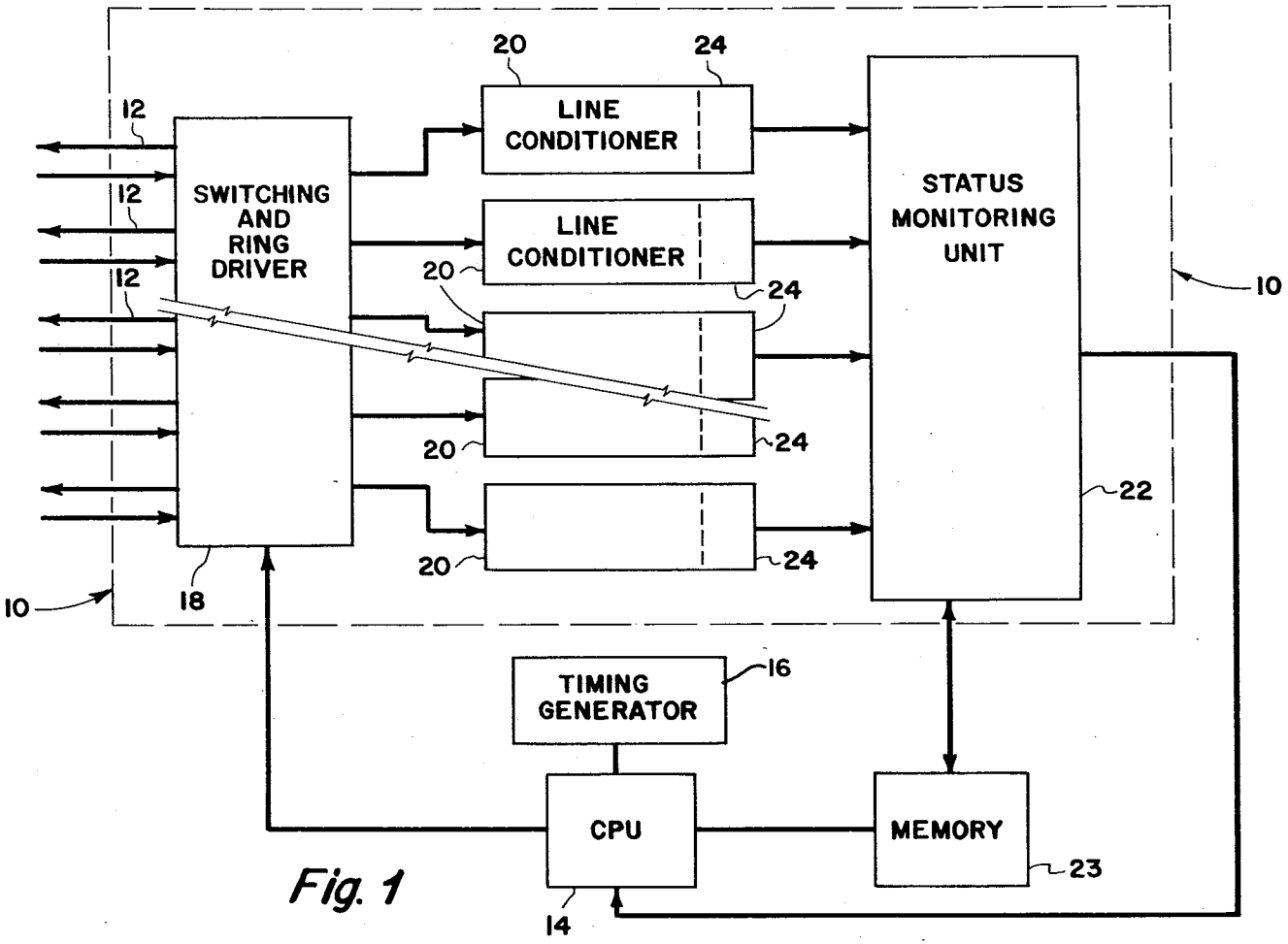
FIG. 1 is an overall functional block diagram of the monitoring system.

Referring to FIG. 1 of the drawings, reference character 10 generally indicates a direct-wire alarm monitoring system for monitoring a plurality of current carrying loops 12. The system 10 is also operably connected to a central processing unit 14 and a suitable timing generator 16.

The monitoring system 10 comprises a switching and ring driver apparatus 18 which is operably connected to the user's direct-wire loops 12 and is likewise connected to the central processing unit (CPU) 14 whereby each user's loop 12 is sequentially scanned. The monitoring unit 10 also comprises a plurality of line conditioner units 20, one for each line 12. Each line conditioner serves to translate the line current into a voltage corresponding to the current level.

Figure 2:
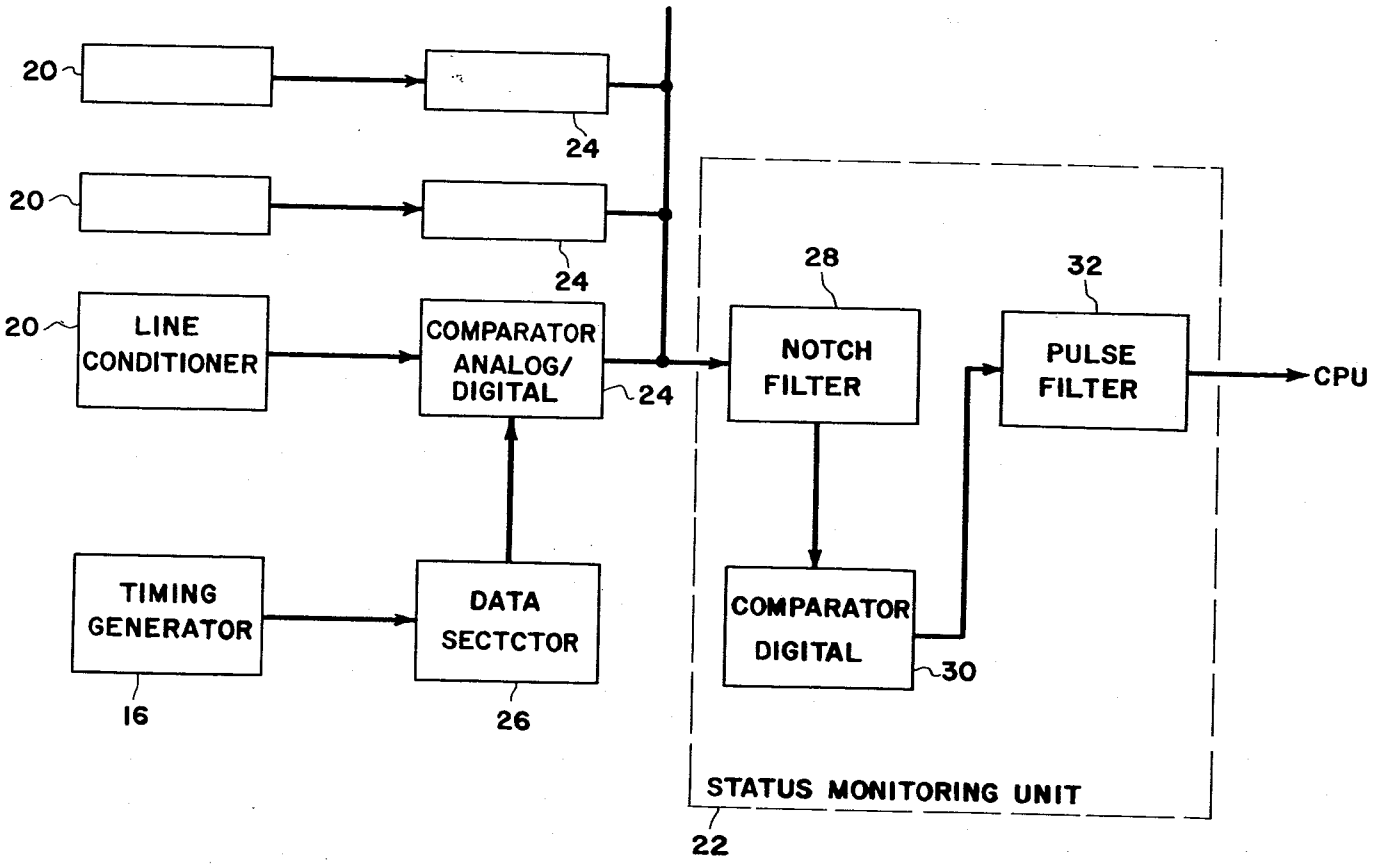
FIG. 2 is a functional block diagram of the status monitoring unit.

Referring to FIGS. 1 and 2, the output of each line conditioner unit 20 is operably connected to a single status monitoring unit 22, the output of which is operably connected to the CPU 14 and the timing generator 16. A digital memory storage unit 23 is also attached to the status monitoring unit 22.

The status monitoring unit 22 comprises a plurality of voltage comparator circuits 24, one for each line conditioner and may be made as an integral part of each line conditioner 20. The comparator serves as a unique analog-to-digital converter wherein it receives a staircase voltage input from a data selector circuit 26, sequentially compares this staircase voltage with the voltages from the line conditioners in order to establish a digital value corresponding to the current level detected in each user's line 12 in a manner that will be hereinafter set forth.

The status monitoring unit 22 further comprises a high-speed digital 60 Hz notch filter 28 for eliminating 60-cycle noise from the system. The output of the notch filter 28 is then applied to the input of a digital comparator 30 wherein the digital voltage level is compared to the previous stable state level to determine whether or not there has been a change in current level on the user's line 12.

If there has been a change in the current level on the user's line, the signal is then passed from the digital comparator 30 into a pulse filter 32 wherein the change is required to stabilize for a set duration of time thereby eliminating any false changes due to noise pulses caused by lightning or other line noise of a pulse nature. The output of the pulse filter than is provided to the central processing unit 14 wherein an alarm is indicated if the change has stabilized for the required duration of time.

As hereinbefore stated, the switching and ring driver circuit 18 is operably connected to the user's direct-wire loops 12 and serves a purpose of not only scanning each of the user's loops but also serves as a line ringing device in order to operate a bell or buzzer at the user's facility.

During normal operations of the direct-wire alarm system, when the user closes his facility he typically turns on his security alarm system whereby a current level change is detected at the monitoring center. This indicates a change in current level and is processed through the monitoring unit in the manner that was hereinbefore set forth. Should the system be at the proper current level the alarm line is rung by the ring driver circuit thereby operating the user's bell or buzzer to let the user know that his security system is functioning properly.

This is done by applying an alternating current to the line or by interrupting the direct current on the line. Either method can be selected for use in this system and is pre-determined based on the type of bell or buzzer apparatus being utilized by a particular user.

Figure 6:
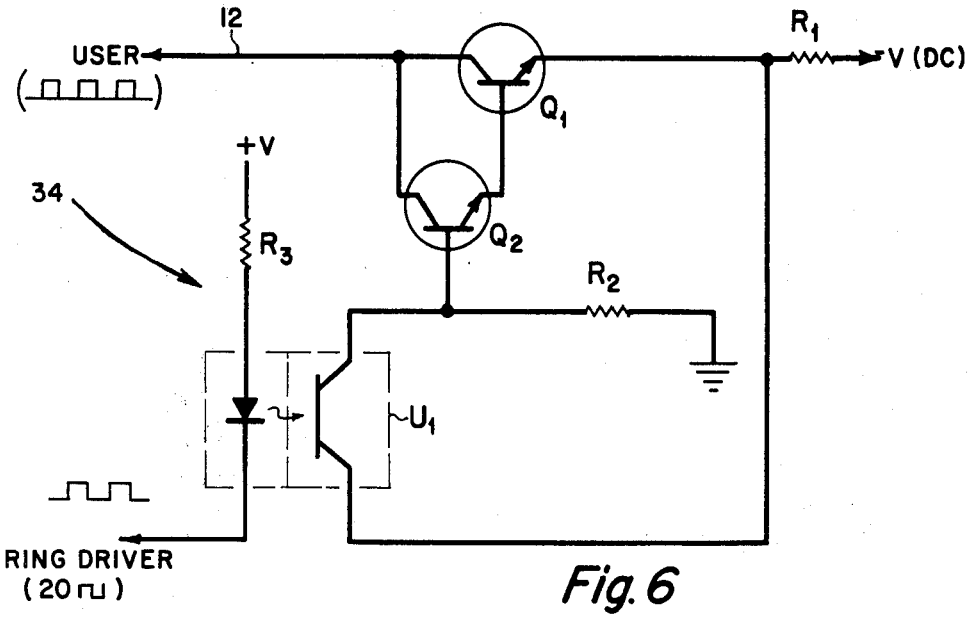
FIG. 6 is a schematic diagram of one embodiment of the ring driver interrupter circuit.

Referring now to FIG. 6, reference character 34 generally indicates a direct current interrupter for simply periodically interrupting the current in the direct-wire alarm system in order to ring the bell or the buzzer located at the user's facility. When it is desired to ring a particular line, a command is given from the central processing unit (CPU) 14 and the line number is stored in the ring driver circuit 18. A 20 Hz square wave signal is then applied by the ring driver to the DC interrupter circuit 34.

The interrupter circuit 34 comprises a Darlington coupled pair of transistors Q1 and Q2 which are placed in series with a first DC power source and the alarm line 12. A suitable load resistor $R_1$ is placed in series with the transistors Q1 and Q2, the base of the transistor Q2 being connected to ground through a resistor $R_2$. Biasing of Q1 and Q2 is accomplished by an optical isolator U1 which is connected to power through a load resistor $R_3$, and the output of which is connected to the base of Q2.

The transistors Q1 and Q2 are normally biased into saturation by $R_2$. When it is desired to ring a particular line, the ring driver applies the 20 Hz square wave directly to the optical isolator U1 causing that isolator to conduct thereby biasing Q1 and Q2 off for that half cycle. When Q1 is biased off for a particular half cycle, this, in turn, interrupts the direct current on that particular line 12. This allows direct ringing from the direct-wire alarm system as opposed to having to provide equipment at each user's facility in order to activate its bell or buzzer through its own power system.

Figure 7:
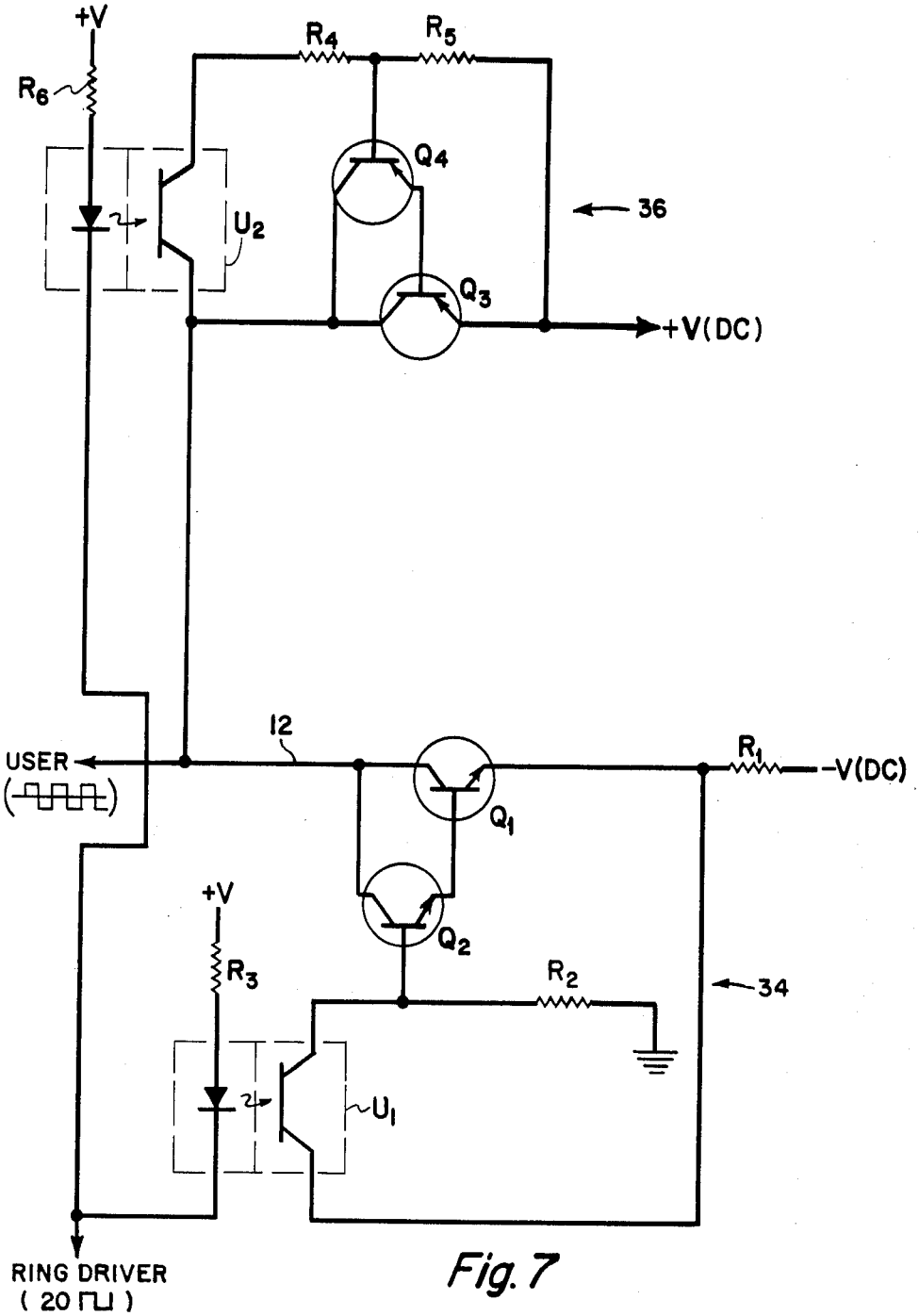
FIG. 7 is a schematic diagram of a second embodiment of the ring driver interrupter circuit.

Referring now to FIG. 7, the line ringer for an alternating current mode of operation is generally depicted by reference character 36. In this case, an interrupter circuit 34 identical to the interrupter circuit hereinbefore described is again connected in series with the line 12. However, in this case a separate interrupter circuit 38 is tied to the line 12.

A second Darlington coupled pair of transistors Q3 and Q4 are connected to the line 12 in series with an alternate DC power source of opposite polarity. The transistors Q3 and Q4 are normally biased off, with the biasing control being provided by a second optical isolator U2. The output of the isolator U2 is connected to the base of the transistor Q4 through a voltage divider made up of resistors $R_4$ and $R_5$. U2 is connected to power through a load resistor $R_6$.

In this case, when the 20 Hz signal is received by the line ringer, during each half cycle, U1 causes the Darlington pair Q1 and Q2 to be biased off for that half cycle while simultaneously biasing Q3 and Q4 on for applying voltage of an opposite polarity. During the next half cycle Q3 and Q4 are biased off while Q1 and Q2 are biased on providing the original DC voltage to the alarm arm line. Therefore, during the second or two that the 20 Hz signal is applied to the AC interrupter circuit 36, an alternating square wave signal is sent to the user's facility to operate his alarm bell or buzzer.

After the alarm line ringing has taken place, the user's facility is on line with a direct current level being passed along the direct wires 12. The switching and ring driver apparatus 18 then sequentially scans each individual line 12. As each individual line is scanned, the current level is detected by the line conditioner circuit 20 and is converted into a digital level corresponding to the current level in the line by the analog-to-digital converter 24. The line conditioner 20 and the voltage comparator and analog-to-digital converter 24 make up the current level detection logic along with the data selector circuit 26.

The function of the current level detection logic is to determine the current level being received on the alarm line. The current range for the embodiment being described herein is divided into four divisions arbitrarily set at the following values:

| Received Current | Interpreted As |
|---|---|
| Less than 14 ma. | 0 ma. |
| 14 to 26 ma. | 20 ma. |
| 26 to 38 ma. | 32 ma. |
| Greater than 38 ma. | 45 ma. |

The current level is interpreted as shown above. From this it can be seen that the three threshold values of 14 ma., 26 ma., and 38 ma. form the boundaries between the four current levels.

The line current is translated through the line conditioning to a voltage in the range of 0 to +5 volts such that the threshold line current produces voltages as follows:

| Received Current | Voltage Produced |
|---|---|
| 14 ma. | 3.69 volts |
| 26 ma. | 1.98 v. |

-continued

| Received Current | Voltage Produced |
|---|---|
| 38 ma. | 0.09 v. |

The voltage resulting from each line conditioning unit 20 is then applied to one input of a corresponding voltage comparator 24, the other input of each voltage comparator 24 being connected to the output of the data selector 26. The output of the data selector 26 is a staircase voltage consisting of the three threshold values 0.09 v., 1.89 v., and 3.69 v.

The voltage comparator 24 comprises an operational amplifier 38 and as hereinbefore set forth, having one input operably connected to the output of the line conditioner 20 and the second input operably connected to the data selector 26 for receiving the staircase voltage. The output of the operational amplifier 38 is connected to a positive voltage through a load resistor $R_7$ and diode D1. Its output is further provided to a two-bit CSR register 40, which may be physically located in memory, one for each line 12.

Each voltage level from the staircase voltage provided by the data selector 26 is held stable for 1.3653 ms. to allow the voltage comparators outputs to stabilize (682.67 us.). Then the comparators 24 outputs are sampled (333.33 ns. per line) sequentially in the remaining 682.67 us. After sampling each line 12, the staircase voltage is set to the next level and the process is repeated.

Before the first (0.09 v.) voltage is applied, the two-bit register 40 is cleared in memory for each line. If the detected voltage is greater than 0.09 v. for a line, a 1 is added to CSR 40. The next (1.89 v.) level is then applied and if the CSR 40 for the line contains a 1 and the detected voltage is greater than 1.89 v., a 1 is again added to the CSR. The final (3.69 v.) level is applied, and if CSR contains a 2 and the detected voltage is again higher than 3.69 v., a 1 is again added to the CSR. Thus, once the voltage being sampled is lower than the threshold voltage, no higher levels will be tested for that line. This process yields a digital numerical result of

| CSR 40 | Current Range |
|---|---|
| 0 | Greater than 38 ma. |
| 1 | 26 to 38 ma. |
| 2 | 14 to 26 ma. |
| 3 | Less than 14 ma. |

On the third pass or the last level of the staircase, the output of the CSR 40 is then gated to an eight-bit register 42. Each time the data selector cycles through a complete staircase of three threshold levels, the digital numerical value stored in the register 40 is gated to the eight-bit register 42 whereby the most recent stored value in the register 42 is $S_0$ representing the last detected current level in the user's line. As the next numerical value is received at 40, the value for $S_0$ shifts to become $S_{-1}$ representing the previous value. The next shift results in $S_{-2}$ representing the second previous current level result and the next shift becomes $S_{-3}$ representing the third previous current level result. These values are held in memory storage 23 between scans.

Figure 5:
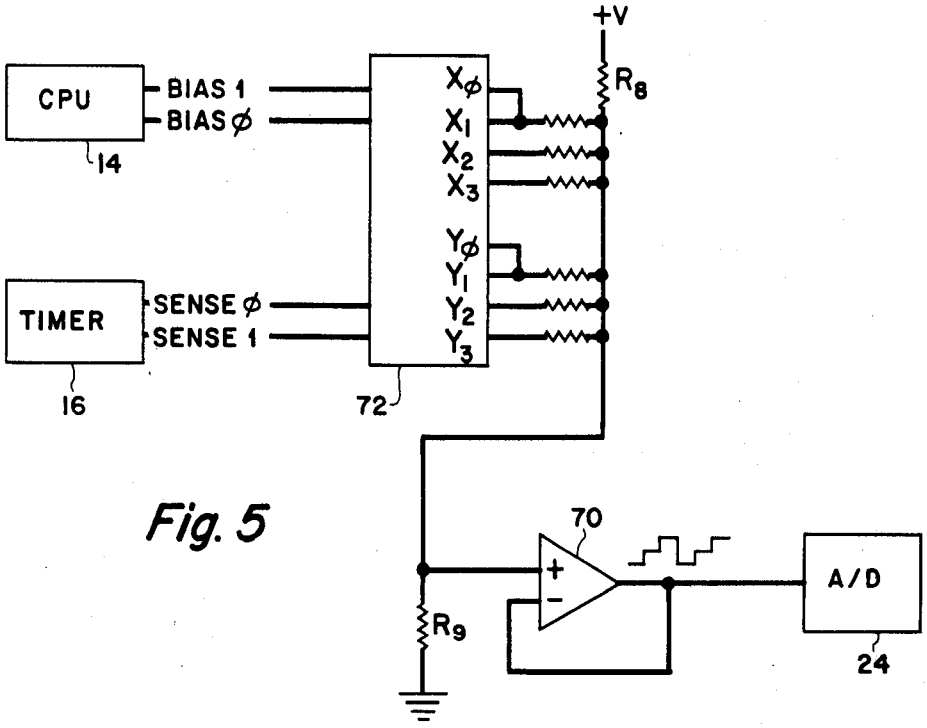
FIG. 5 is a schematic diagram of the data selector which is used in conjunction with the analog-to-digital converter.

Referring now to FIG. 5, reference character 26 generally indicates the data selector circuit which is provided with an operational amplifier feedback chip 70 which produces a repeating staircase voltage of three different voltage levels as hereinbefore set forth. The input to the operational amplifier chip 70 is connected to power through a voltage divider made up of register $R_8$ and $R_9$. The input is also connected to the timing generator 16 through a two-way bias control switching device 72.

The switching device is connected to the input of the operation amplifier 70 through a network of resistors Xi and Yi. Two bias voltages Bias 1 and Bias 0 are provided from the CPU 14 and are operably connected to the switching means 72. When neither Bias 0 nor Bias 1 have been activated, the Resistors X1 and Y1 provide a nominal staircase voltage level to the operation amplifier 70 which, upon adding voltage levels from Sense 0 and Sense 1 (timing generator 16) produces the following voltage levels and their corresponding current levels:

| Voltage | Current Level | Sense |
|---|---|---|
| 0.09 v. | 38 ma. | 0 |
| 1.89 v. | 26 ma. | 1 |
| 3.69 v. | 14 ma. | 0 and 1 |

In order to get a finer resolution of the current level on each line 12, the resistor networks are brought into play by the Bias control (CPU). When a voltage is applied to Bias, resistors X2 and Y2 set the staircase threshold voltages as follows:

| Voltage | Current Level |
|---|---|
| .69 v. | 34 ma. |
| 2.49 v. | 22 ma. |
| 3.69 v. | 14 ma. |

When Bias 1 is selected, resistors X3 and Y3 set the staircase voltage levels as follows:

| Voltage | Current Level |
|---|---|
| .09 v. | 38 ma. |
| 1.29 v. | 30 ma. |
| 3.09 v. | 18 ma. |

Through this bias adjustment of the threshold staircase voltages, current levels varying only ±2 ma. from the nominal center values can be detected. The alternate levels, Bias 0 and Bias 1, can be selected at any time from the CPU.

Since direct-wire alarm lines are subject to high levels of 60 Hz noise signals, the digitized current levels are passed through the 60 Hz notch filter 28. The theory of this filter is based on the fact that a sign wave integrated over exactly one cycle yields a result of 0. It can be seen that the period of a 60 Hz sign wave (16.67 ms.) corresponds closely to four samples, 4.096 ms. apart (16.384 ms.).

The integral is arrived at digitally by adding the four latest samples and dividing by four to give a simple numerical average. If the digital input to this filter was highly resolved, this would be all that it required to very effectively attenuate the 60 Hz signal.

However, due to truncation or rounding effects of the low resolution signal used by this system, it was found to be desirable to weight the new filtered result toward the previous filtered result each time a result is calculated.

Figure 3:
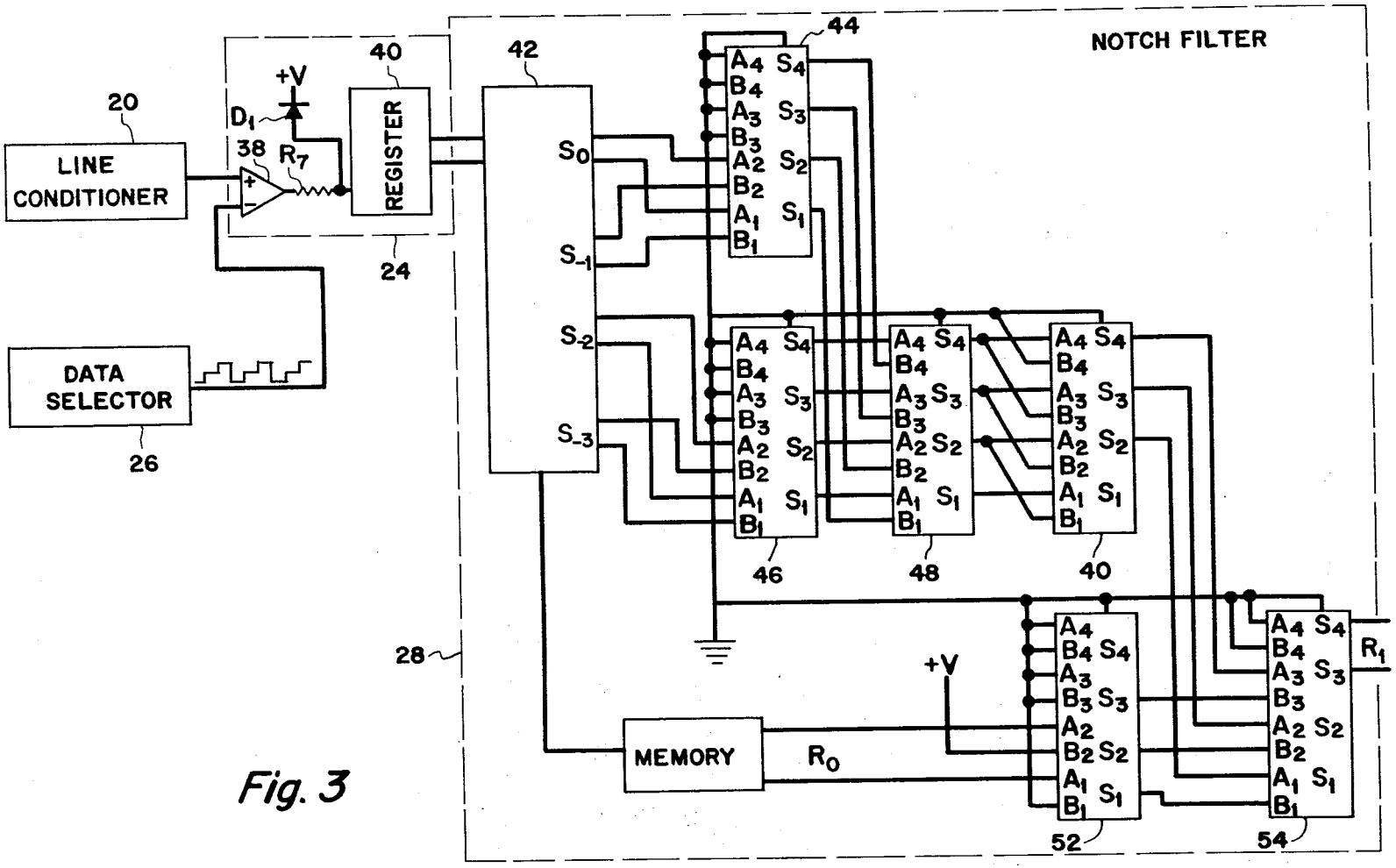
FIG. 3 is a schematic block diagram of the notch filter and input analog-to-digital converter.
Figure 4:
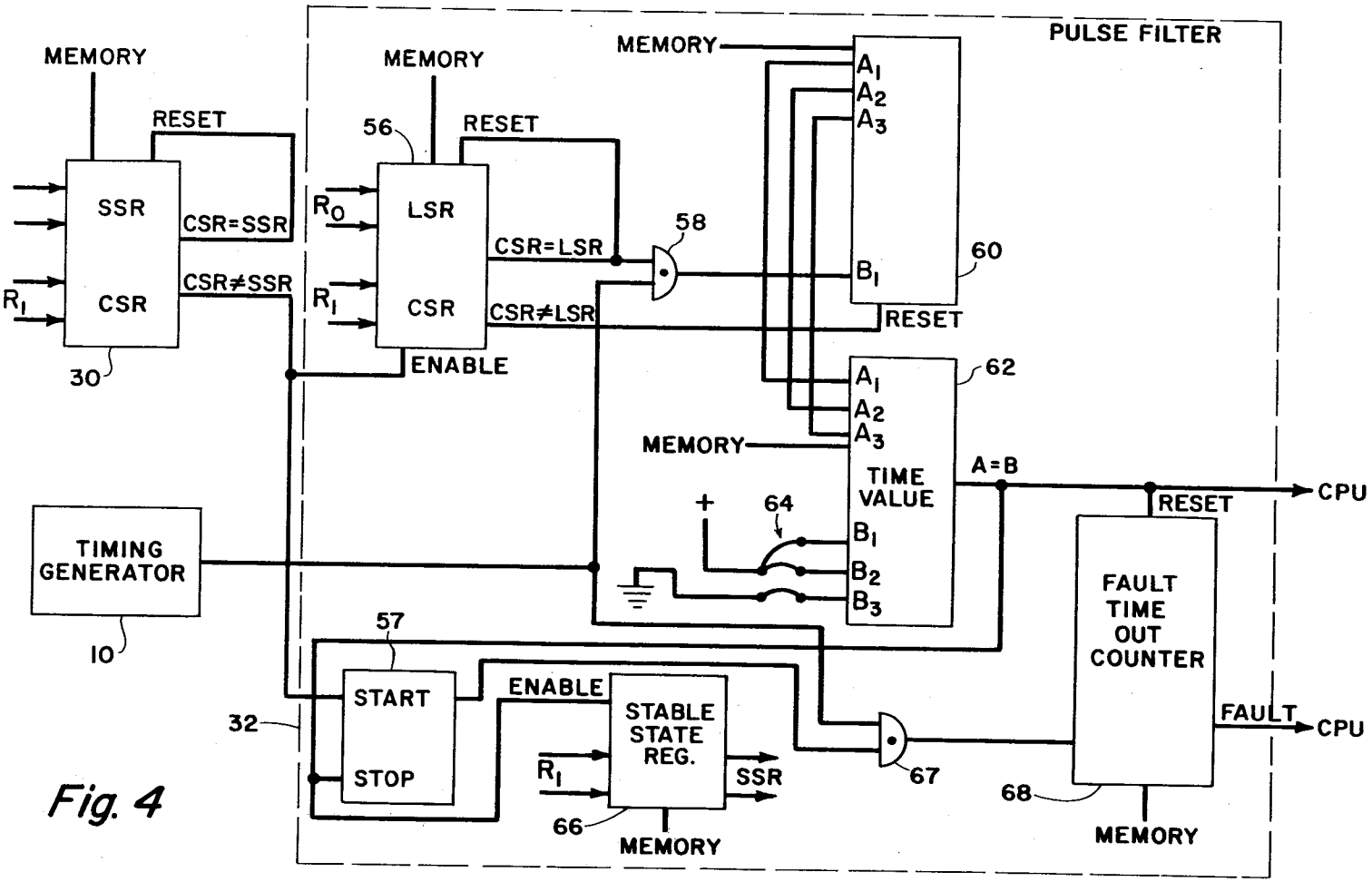
FIG. 4 is a schematic block diagram of the pulse filter.

Referring now to FIG. 3, the weighting is accomplished by a plurality of four-bit adders 44, 46, 48, 50, 52 and 54. Each adder has two four-bit inputs A1, A2, A3, A4 and B1, B2, B3, B4, with a single four-bit output S1, S2, S3 and S4.

$S_0$ is applied to A1 and A2 of the adder 44 while $S_{-1}$ is applied to B1 and B2 of the adder 44, the output sum being $S_0$ plus $S_{-1}$. $S_{-1}$ and $S_{-2}$ are applied to A1, A2 and B1, B2, respectively, of the adder 46, the output being $S_{-2}$ plus $S_{-3}$.

The output of adder 44 is made as an input to the B terminals of adder 48 while the output of the adder 46 is applied to the A terminals of adder 48, the output of adder 48 and 50 plus $S_{-1}$ plus $S_{-2}$ plus $S_{-3}$.

The output of adder 48 is then applied to the A inputs of adder 50. The output of adder 48 is shifted up which divides by 2 and applied to adder 50. This is accomplished by applying the outputs S2, S3 and S4 of adder 48 to inputs B1, B2 and B3, respectively, of adder 50 while a 0 is applied to input B4 of adder 50. The output of adder 50 then is three-halves of the sum of $S_0$ plus $S_{-1}$ plus $S_{-2}$ plus $S_{-3}$.

S1, S2 and S3 of adder 50 then is applied to inputs A1, A2 and A3, respectively, of adder 54 which in effect has divided the output of adder 50 by two.

The previous result of the notch filter represented by R0 is applied from memory 23 to inputs A1 and A2 of adder 52. A positive voltage input is then applied to B2 of adder 52 so that the output of adder 52 represents R0 plus two. The output of 52 is then applied to the B input of 54 for adding to the output of adder 52. The resulting output of the notch filter then is represented by R1 and is taken from S3 and S4 of the adder 54. This, in effect, divides the result of the adder 54 by four.

Therefore, the output of the notch filter, R1, can be represented by the equation:

$$R1 = \left[ (S_0 + S_{-1} + S_{-2} + S_{-3}) \cdot \frac{3}{2} + (R0 \cdot 2) + 4 \right] /8.$$

This weighted result R1 amounts to three-fourths of one-fourth of the sum of the last four samples, $S_O$, $S_{-1}$, $S_{-2}$ and $S_{-3}$, added to one-fourth of the previous filter result RO. A further constant of one-half is required to provide overall rounding.

The output R1 of the notch filter is then applied to one input of the four-bit digital comparator 30 and is designated CSR. The other input of the digital comparator 30 represents the last stable state value for that particular user's line, and hence represents the required voltage level for normal operation. This is where a comparison is made to see whether or not the current level at the user's facility has changed possibly due to a tripped security device. However, if an alarm were sounded at every indicated change of condition at the user's facility, many false alarms would be generated due to noise pulses caused by lightning or other line noise of a pulse nature. The pulse filter 32 is therefore designed to eliminate extraneous pulses by requiring the changed condition to stabilize for a pre-set duration of time which would indicate that a changed condition actually exists rather than a change due to an extraneous pulse.

The pulse filter 32 also eliminates the apparent pulses created by the digital 60 Hz notch filter when a large 60 Hz noise signal is present. The maximum length of noise pulse to be filtered (that is, the minimum system response time) is strap selectable in multiples of 4.096 ms., from 8.192 ms. to 28.672 ms.

Therefore, the input to the filter, indicating the changed condition, is not gated to the output in order to set off an alarm until it has remained stable at one value for a given number of samples.

When the value R1 represented by CSR from the notch filter is compared with the required value SSR in the digital comparator, if CSR equals SSR, then the digital comparator 30 is simply reset for the next sample. If, on the other hand, CSR is not equal to SSR indicating a change in state, the R1 value is gated into the pulse filter along with the previous filter result RO. Simultaneously, a latching mechanism such as a flip flop 57 is latched on for a purpose that will be hereinafter set forth.

Both R0 and R1 are therefore applied to a second digital comparator 56 which serves as the input for the pulse filter 30.

In the comparator 56, if R0 is equal to R1 (LSR=CSR), the comparator 56 is reset but applies a gating pulse through an AND gate 58 which, along with a timing generator 16 pulse also applied to the gate 58, provides an input to increment a counter 60. A second comparator 62 which is strap selectable in multiples of 4.096 ms. by a patch apparatus 64, is connected to the counter 60 so that when the counter 60 fills to a level preset into comparator 62 indicating that R0 has remained equal to R1 for the strapped amount of time, a signal is emitted from the comparator 62 to the CPU indicating an alarm condition exists, and simultaneously gates the new state value into a stable state register 66, providing a new value for SSR.

On the other hand, if the comparison made in the voltage comparator 56 indicates that CSR (R1) is not equal to LSR (R0), an output signal is transmitted to the counter 60 thereby resetting that counter to 0 which also disables the AND gate 58.

Now going back to the case where the output of the voltage comparator 30 indicates that CSR is not equal to SSR wherein the voltage comparator 56 is enabled. Simultaneously, the latching device 57 is latched on thereby providing an enabling signal to an AND gate 67 which gates timing signals into a fault time-out counter 68 which is typically set to fill after 32 time increments (131.072 ms.) have passed. Normally the counter 60 will be strapped by the counter 62 to a value of approximately 6 counts. Therefore, once a change of signal is detected, if this change does not stabilize before the fault time-out counter 68 reaches its maximum, a fault signal will be sent to the CPU indicating a line noise problem.

Unlike an analog filter, this pulse filter is unaffected by pulse amplitude and is therefore able to eliminate most line noise while retaining a fast response time.

In the case where a true state change has occurred, the output of the counter 62, in addition to being provided to the CPU and enabling the stable state register 66, also resets the counter 68 and unlatches the latching apparatus 57.

From the foregoing it is apparent that the present invention provides a direct-wire alarm monitoring system for high-speed sequential monitoring of a plurality of DC current loops typically used in silent security alarm systems. As hereinbefore pointed out, the monitoring is accomplished digitally and the high-speed feature is maintained by eliminating both 60 cycle noise and pulse noise digitally as opposed to using the conventional methods of eliminating noise while the signal is in its analog form.

Whereas the present invention has been described in particular relation to the drawings attached hereto, other and further modifications apart from those shown or suggested herein may be made within the spirit and scope of the invention.

What is claimed is:

1. A direct-wire alarm monitoring system for high-speed sequential monitoring of a plurality of DC current loops comprising:

(a) an analog-to-digital converter means for each loop to convert the current level to a digital value;

(b) a digital notch filter operably connected to the analog-to-digital converter to eliminate periodic noise of a pre-determined period from each loop sequentially;

(c) a digital comparator operably connected to the output of the notch filter to detect changes in current level;

(d) a digital pulse filter operably connected to the output of the digital comparator to eliminate pulse noise if a change in current level is detected by the digital comparator; and (e) means for sequentially sampling the output of the analog-to-digital converter means for each loop and applying that sample sequentially to the digital notch filter.

2. A monitoring system as set forth in claim 1 wherein each analog-to-digital converter means comprises a line conditioner for translating current level to a proportional voltage level, a data selector for establishing a plurality of sequential staircase voltages, a voltage comparator operably connected to the line conditioner and the data selector to sequentially compare the voltage level output of the line conditioner to each voltage level of the staircase output of the data selector, and a digital register operably connected to the output of the voltage comparator to sequentially receive each comparator output whereby when each staircase is completed, the digital register will contain a value proportional to the current level in the loop.

3. A monitoring system as set forth in claim 2 wherein the output of the voltage comparator is a "1" if the line conditioner voltage is greater than the level of the threshold staircase voltage and wherein the output of the voltage comparator is a "0" if the line conditioner voltage is less than the level of the threshold staircase voltage.

4. A monitoring system as set forth in claim 3 wherein the staircase voltage contains three threshold voltage levels and the digital value representing current level contains two bits, 0, 1, 2, or 3.

5. A monitoring system as set forth in claim 1 wherein the notch filter comprises a digital adder means for integrating a plurality of digital values, each corresponding to the current level over one cycle of expected periodic noise.

6. A monitoring system as set forth in claim 5 wherein the expected periodic noise is 60 Hz.

7. A monitoring system as set forth in claim 6 wherein the number of values integrated in one cycle is 4.

8. A monitoring system as set forth in claim 7 wherein the digital adder means comprises a second digital adder means operably connected to the first-mentioned digital adder means to weight the notch filter output toward the previous notch filter output.

9. A monitoring system as set forth in claim 8 wherein the weighting comprises approximately three-fourths of one-fourth of the sum of the four digital values to one-fourth of the previous notch filter result.

10. A monitoring system as set forth in claim 1 wherein the digital pulse filter comprises a first counter means for holding a change of current level indication for a pre-set duration before outputting that change from the pulse filter and a second counter means operably connected to the first counter means and to the digital comparator for blocking the output of the pulse filter indicating a change if said second counter means fills before said first counter means fills.

11. A monitoring system as set forth in claim 10 wherein said second counter means has a greater capacity than the first counter means.

12. A monitoring system as set forth in claim 11 wherein the second counter means comprises a fault time-out counter which is activated by a change of current level detected by the digital comparator and is de-activated only by either filling to capacity thereby blocking the output of the pulse filter or is de-activated by the filling of the first counter means indicating that a change of current level has remained stable for its pre-set duration.

13. A monitoring system as set forth in claim 12 wherein the capacity of the first counter means is strapped selectable over a range less than the capacity of said second counter means.

14. A monitoring system as set forth in claim 2 wherein the data selector comprises means to selectively adjust the threshold voltage levels of the staircase voltages up or down to obtain a finer resolution of the current level in each loop.

* * * * *